US008474492B2

(12) United States Patent
Bonner et al.

(10) Patent No.: US 8,474,492 B2
(45) Date of Patent: Jul. 2, 2013

(54) AUTOMATIC SHUT-OFF NOZZLE FOR USE IN A NON-OVERFLOW LIQUID DELIVERY SYSTEM

(75) Inventors: Mark Bonner, Frenchtown, NJ (US); Gary Underhill, Moncton (CA)

(73) Assignee: Fuel Transfer Technologies Inc., Moncton (CA)

( * ) Notice: Subject to any disclaimer, the term of this patent is extended or adjusted under 35 U.S.C. 154(b) by 290 days.

(21) Appl. No.: 12/696,041

(22) Filed: Jan. 28, 2010

(65) Prior Publication Data

US 2010/0200106 A1 Aug. 12, 2010

Related U.S. Application Data

(60) Provisional application No. 61/147,761, filed on Jan. 28, 2009, provisional application No. 61/147,759, filed on Jan. 28, 2009.

(51) Int. Cl.
*B65B 57/06* (2006.01)

(52) U.S. Cl.
USPC ..... 141/206; 141/45; 141/115; 141/305

(58) Field of Classification Search
USPC ..... 141/45, 59, 65, 115, 198, 206, 290, 141/302, 305, 308
See application file for complete search history.

(56) References Cited

U.S. PATENT DOCUMENTS 1,325,991 A * 12/1919 King ..... 141/59
1,834,453 A * 12/1931 Gavaza ..... 141/59
3,561,503 A * 2/1971 Rogge ..... 141/7
3,599,675 A 8/1971 Sievenpiper
3,635,264 A 1/1972 Milburn
3,850,208 A 11/1974 Hamilton (Continued)

FOREIGN PATENT DOCUMENTS

CA 2613929 A1 6/2008
CA 2601607 A1 3/2009

(Continued)

OTHER PUBLICATIONS

Pezoulas, Lambros—Canadian Intellectual Property Office, "International Search Report" for corresponding International Patent Application No. PCT/CA2010/000116, dated May 11, 2010, Canada.

(Continued)

*Primary Examiner* — Jason K Niesz
(74) *Attorney, Agent, or Firm* — Norton Rose Fulbright Canada LLP

(57) ABSTRACT

An automatic shut-off nozzle comprises a liquid delivery conduit and a liquid recovery conduit. A valve has a first movable valve portion movable between a valve closed position whereat liquid is precluded from being dispensed from the liquid-dispensing outlet of the liquid delivery conduit and a valve open position whereat liquid is permitted to be dispensed from the liquid-dispensing outlet of the liquid delivery conduit. A manually operable valve control mechanism is reconfigurable between an operating configuration whereat force can be transmitted from the valve control mechanism to the valve to thereby move the first movable valve portion to the valve open position, and a non-operating configuration whereat force cannot be transmitted from the valve control mechanism to the valve. A liquid sensor has a rest state and an actuated state whereat the liquid sensor reconfigures the manually operable valve control mechanism from the operating configuration to the non-operating configuration.

19 Claims, 12 Drawing Sheets

U.S. PATENT DOCUMENTS

| | | | | | |
|---|---|---|---|---|---|
| 3,974,865 | A | | 8/1976 | Fenton et al. | |
| 3,982,571 | A | | 9/1976 | Fenton et al. | |
| 3,996,977 | A | | 12/1976 | Hansel | |
| 4,068,687 | A | | 1/1978 | Long | |
| 4,071,059 | A | * | 1/1978 | Hansel | 141/206 |
| 4,095,626 | A | | 6/1978 | Healy | |
| 4,166,485 | A | | 9/1979 | Wokas | |
| 4,253,804 | A | | 3/1981 | Vanderjagt | |
| 4,258,760 | A | | 3/1981 | Moore | |
| 4,649,969 | A | | 3/1987 | McMath | |
| 4,687,033 | A | | 8/1987 | Furrow et al. | |
| 4,714,172 | A | | 12/1987 | Morris | |
| 4,972,972 | A | | 11/1990 | Goguen | |
| 5,033,492 | A | * | 7/1991 | Mertens et al. | 134/166 R |
| 5,156,199 | A | | 10/1992 | Hartsell et al. | |
| 5,190,218 | A | | 3/1993 | Kayser et al. | |
| 5,297,594 | A | | 3/1994 | Rabinovich | |
| 5,435,357 | A | | 7/1995 | Woods et al. | |
| 5,476,125 | A | | 12/1995 | Mitchell | |
| 5,522,440 | A | | 6/1996 | Mitchell | |
| 5,713,401 | A | | 2/1998 | Weeks | |
| 5,832,970 | A | | 11/1998 | Carow | |
| 5,860,459 | A | * | 1/1999 | Reed et al. | 141/198 |
| 6,017,493 | A | | 1/2000 | Cambron et al. | |
| 6,069,330 | A | | 5/2000 | Crevling, Jr. et al. | |
| 6,155,464 | A | | 12/2000 | Vachon | |
| 6,283,173 | B1 | | 9/2001 | Osborne | |
| 6,374,868 | B1 | | 4/2002 | Channing | |
| 6,397,902 | B1 | | 6/2002 | Murphy | |
| 6,415,788 | B1 | | 7/2002 | Clawson et al. | |
| 6,419,169 | B1 | | 7/2002 | Rennecker et al. | |
| 6,589,219 | B1 | | 7/2003 | Shibuya | |
| 6,779,694 | B2 | | 8/2004 | Young | |
| 6,851,584 | B2 | | 2/2005 | White | |
| 6,889,732 | B2 | | 5/2005 | Allen | |
| 6,968,875 | B2 | | 11/2005 | Nielsen | |
| 7,063,112 | B2 | | 6/2006 | Fink, Jr. et al. | |
| 7,082,969 | B1 | | 8/2006 | Hollerback | |
| 7,128,108 | B2 | | 10/2006 | Nielsen | |
| 7,275,665 | B2 | | 10/2007 | Young | |
| 7,513,394 | B2 | | 4/2009 | Bone | |
| 7,513,395 | B2 | | 4/2009 | Labinski et al. | |
| 7,594,616 | B2 | | 9/2009 | Hupp | |
| 8,066,037 | B2 | | 11/2011 | Lawrence et al. | |
| 2001/0037807 | A1 | | 11/2001 | Kong | |
| 2008/0159889 | A1 | | 7/2008 | Exner et al. | |
| 2008/0245282 | A1 | | 10/2008 | Richards | |
| 2008/0295916 | A1 | * | 12/2008 | Bonner | 141/206 |
| 2010/0294379 | A1 | | 11/2010 | Erdmann | |

FOREIGN PATENT DOCUMENTS

| | | | |
|---|---|---|---|
| CA | 2639492 | A1 | 4/2009 |
| CN | 1139415 | A | 1/1997 |
| CN | 1898617 | A | 1/2007 |
| EP | 0435486 | A2 | 3/1991 |
| EP | 0468384 | A1 | 1/1992 |
| EP | 1460033 | A1 | 9/2004 |
| EP | 1783368 | A1 | 5/2007 |
| EP | 1936188 | A1 | 6/2008 |
| WO | 9831628 | A1 | 7/1998 |
| WO | 98/56710 | A1 | 12/1998 |
| WO | 2004020298 | A1 | 3/2004 |
| WO | 2007079577 | A1 | 7/2007 |
| WO | 2008009119 | A2 | 1/2008 |
| WO | 2008061352 | A2 | 5/2008 |

OTHER PUBLICATIONS

Pezoulas, Lambros—Canadian Intellectual Property Office, "International Search Report" for corresponding International Patent Application No. PCT/CA2010/000115, dated May 11, 2010, Canada.

Pezoulas, Lambros—Canadian Intellectual Property Office, "International Search Report" for corresponding International Patent Application No. PCT/CA2010/000112, dated May 11, 2010, Canada.

Hijazi, Mazen—Canadian Intellectual Property Office, "Examiner's Requisition" for corresponding Canadian Patent Application No. 2,691,431, dated Jul. 12, 2012, Canada.

Syed, Suresh—New Zealand Intellectual Property Office, "Examination Report" for corresponding New Zealand Patent Application No. 594742 dated Aug. 2, 2012, New Zealand.

Syed, Suresh—New Zealand Intellectual Property Office, "Examination Report" for corresponding New Zealand Patent Application No. 594745 dated Aug. 6, 2012, New Zealand.

European Patent Office "Extended European Search Report" for corresponding European Patent Application No. 10735460.7 dated Oct. 15, 2012, Germany.

European Patent Office "Extended European Search Report" for corresponding European Patent Application No. 10735459.9 dated Oct. 29, 2012, Germany.

European Patent Office "Extended European Search Report" for corresponding European Patent Application No. 10735458.1 dated Oct. 29, 2012, Germany.

Davis, Paul—Fisher Adams Kelly "Response to Examination Report" for corresponding New Zealand Patent Application No. 594745 dated Nov. 19, 2012, Australia.

Syed, Suresh—New Zealand Intellectual Property Office "Notice of Acceptance" for corresponding New Zealand Patent Application No. 594745 dated Nov. 28, 2012, New Zealand.

Syed, Suresh—New Zealand Intellectual Property Office "Examination Report" for corresponding New Zealand Patent Application No. 594743 dated Aug. 7, 2012, New Zealand.

Chao, Wu—State Intellectual Property Office of the People's Republic of China "Office Action & Search Report" for corresponding Chinese Patent Application No. 201080014293.9 dated Oct. 26, 2012, China.

State Intellectual Property Office of the People's Republic of China "Office Action & Search Report" for corresponding Chinese Patent Application No. 201080014292.4 dated Nov. 26, 2012, China (Only translation provided).

* cited by examiner

AUTOMATIC SHUT-OFF NOZZLE FOR USE IN A NON-OVERFLOW LIQUID DELIVERY SYSTEM

This application is a non provisional patent application claiming priority from U.S. Provisional Patent Application Ser. No. 61/147,761 filed on Jan. 28, 2009, which is herein incorporated by reference, and from U.S. Provisional Patent Application Ser. No. 61/147,759 filed on Jan. 28, 2009.

FIELD OF THE INVENTION

The present invention relates to nozzles for use in a non-overflow liquid delivery system, and more particularly relates to auto shut-off nozzles for use in a non-overflow liquid delivery system, for delivering liquid into a destination container, and recovering excess liquid from a destination container.

BACKGROUND OF THE INVENTION

The spillage of liquids is a common occurrence when transferring liquids from one container to another, such as transferring fuel from a fuel storage container, to a destination container, such as a fuel tank that supplies an internal combustion engine. Spillage can occur in the form of overflowing the destination container, or in the form of dripping or draining of the device that is used to transfer the liquid. Very frequently, spillage occurs due to user error, stemming from improper use of the device that is used to transfer the liquid, or because of an oversight where the user is not being sufficiently attentive during the process of transferring the liquid. The spillage of liquids is a messy, wasteful, costly and potentially hazardous problem.

Generally, it is desirable to reduce or eliminate the spillage of liquids that occurs when transferring liquids from a source container to a destination container. This is especially true for liquids that are toxic, volatile or flammable. In instances where toxic, volatile or flammable liquids are being transferred, spillage poses a significant danger to those in close proximity and to the surrounding environment in the form of pollution.

Portable fuel containers typically utilize a flexible or rigid spout securely attached thereto at an upper outlet where in order to deliver liquid from these portable containers, the portable container is typically lifted and tilted so that the liquid can be poured from the spout into the destination container. This method results in a lot of spillage and that has led to the development of refueling systems which comprise a pump, hose and typically a nozzle. In these systems, the dispensing end of the nozzle is placed into the destination container, and liquid is delivered from the portable container to the destination container, either by means of pumping or siphoning. In each case where such portable containers are used, be it pouring, pumping or siphoning, the opportunity for spilling due to improper use or operator error always exists.

In order to preclude such overflow and spilling, automatic shut-off nozzles can be used. When used properly, these auto-shutoff nozzles will automatically shut off the flow of liquid as the receiving container becomes full to prevent overflowing. Even with such auto-shutoff nozzles, spillage still occurs and often occurs in the following four instances.

In one such instance, spillage can occur with automatic shut-off nozzles when a user attempts to slowly "top off the tank". Accordingly, when fuel is dispensed at a slow rate, the auto-shutoff mechanism does not create enough of a decrease in vapor pressure to close the valve in the nozzle when the fuel level in the destination container reaches the tip of the spout. Accordingly, the flow of fuel into the destination container will continue, resulting in the overflow of the destination container.

In the second instance, dripping and drainage can occur when the nozzle is removed from the destination container soon after the nozzle has been shut off, which allows a small but significant amount of fuel to drain from the spout of the nozzle. This is due to the placement of the valve within the body of the nozzle, thus leaving several centimeters of open spout to drain. This applies to the liquid delivery conduit and in some instances the vapor recovery conduit.

A third instance of spillage occurs when filling fuel tanks, and the like, that have a narrow fill pipe. This diameter is only slightly greater than the diameter of the spout. The peripheral volume of air between the spout and the fill pipe, above the vapor inlet of the spout, is quite small. Accordingly, it takes only a brief amount of time for the flow of fuel to fill this peripheral volume and subsequently overflow the fill pipe.

This is true if there is a delay in the auto shutoff mechanism for instance if the auto shutoff mechanism fails or if the user is pumping slowly in order to "top off the tank" and when using spouts that are attached directly to containers.

A fourth instance of spillage occurs due to operator error, stemming from improper use of the dispensing system, or because of an oversight where the user is not paying attention during the filling process.

In order to circumvent the problem of relying on venturies or vapor recovery to actuate a valve closing mechanism, U.S. Pat. No. 7,082,969, issued Aug. 1, 2006, to Hollerback, uses a liquid sensor in the vapor recovery line. The liquid sensor ultimately causes the pump of the fuel delivery system to shut off. While this system might work well in commercial fuel delivery systems, it has no application in portable manually operable fuel transfer systems that have no source of power, and therefore is not universally applicable. Further, there is a lag between the time the pumps shuts off and the closing of the valve in the liquid delivery line and the vapor recovery line. In a portable manually operable fuel transfer system, this lag can readily lead to the overflowing of the destination container, and also can allow the dripping and drainage of fuel from the spout of the nozzle.

Another important consideration with such automatic shut-off nozzles used in portable fuel transfer systems is that of cost. Such automatic shut-off nozzles have their genesis in the design of nozzles used in commercial fuel filling stations, and accordingly have numerous moving parts. Reducing the number of moving parts would both reduce the cost of the nozzle and reduce the chance of either temporary or permanent failure of the nozzle.

It is an object of the present invention to provide an automatic shut-off nozzle for use in a non-overflow liquid delivery system.

It is an object of the present invention to provide an automatic shut-off nozzle for use in a non-overflow liquid delivery system for delivering liquid into a destination container, and recovering excess liquid from the destination container.

It is an object of the present invention to provide an automatic shut-off nozzle for use in a non-overflow liquid delivery system for delivering liquid into a destination container, and recovering excess liquid from the destination container, wherein liquid is sensed to close valve in the spout in the automatic shut-off nozzle.

It is an object of the present invention to provide an automatic shut-off nozzle for use in a non-overflow liquid delivery system, wherein, in use, the volume of liquid in the destination container stops increasing once liquid in the destination container covers the liquid-receiving inlet of the nozzle.

It is an object of the present invention to provide an automatic shut-off nozzle for use in a non-overflow liquid delivery system, which nozzle substantially eliminates spillage due to overflowing of liquid from the destination container.

It is an object of the present invention to provide an automatic shut-off nozzle for use in a non-overflow liquid delivery system, which nozzle will greatly reduce spillage due to dripping or drainage that can occur once the liquid transfer process is complete.

It is an object of the present invention to provide an automatic shut-off nozzle for use in a non-overflow liquid delivery system, wherein the flow control valve controls both the flow of liquid in the liquid delivery conduit and the flow of liquid in the liquid recovery conduit.

It is an object of the present invention to provide an automatic shut-off nozzle for use in a non-overflow liquid delivery system, wherein the flow control valve is located in the spout of the nozzle.

It is an object of the present invention to provide an automatic shut-off nozzle for use in a non-overflow liquid delivery system, which nozzle minimizes the chance of user error.

It is an object of the present invention to provide an automatic shut-off nozzle for use in a non-overflow liquid delivery system, which nozzle helps preclude the pollution of the environment.

It is an object of the present invention to provide an automatic shut-off nozzle for use in a non-overflow liquid delivery system, which nozzle is cost effective to manufacture.

It is an object of the present invention to provide an automatic shut-off nozzle for use in a non-overflow liquid delivery system, which is part of a portable fuel transfer system.

It is an object of the present invention to provide an automatic shut-off nozzle for use in a non-overflow liquid delivery system, which is part of a portable fuel transfer system, for delivering liquid into a destination container, and recovering excess liquid from the destination container.

It is an object of the present invention to provide an automatic shut-off nozzle for use in a non-overflow liquid delivery system, which is part of a portable fuel transfer system, for delivering liquid into a destination container, and recovering excess liquid from the destination container, wherein liquid is sensed to close valve in the spout in the automatic shut-off nozzle.

It is an object of the present invention to provide an automatic shut-off nozzle for use in a non-overflow liquid delivery system, which is part of a portable fuel transfer system, wherein, in use, the volume of liquid in the destination container stops increasing once liquid in the destination container covers the fluid-receiving inlet of the nozzle.

It is an object of the present invention to provide an automatic shut-off nozzle for use in a non-overflow liquid delivery system, which is part of a portable fuel transfer system, which nozzle substantially eliminates spillage due to overflowing of liquid from the destination container.

It is an object of the present invention to provide an automatic shut-off nozzle for use in a non-overflow liquid delivery system, which is part of a portable fuel transfer system, which nozzle will greatly reduce spillage due to dripping or drainage that can occur once the liquid transfer process is complete.

It is an object of the present invention to provide an automatic shut-off nozzle for use in a non-overflow liquid delivery system, which is part of a portable fuel transfer system, wherein the flow control valve controls both the flow of liquid in the liquid delivery conduit and the flow of liquid in the liquid recovery conduit.

It is an object of the present invention to provide an automatic shut-off nozzle for use in a non-overflow liquid delivery system, which is part of a portable fuel transfer system, wherein the flow control valve is located in the spout of the nozzle.

It is an object of the present invention to provide an automatic shut-off nozzle for use in a non-overflow liquid delivery system, which nozzle minimizes the chance of user error.

It is an object of the present invention to provide an automatic shut-off nozzle for use in a non-overflow liquid delivery system, which is part of a portable fuel transfer system, which nozzle helps preclude the pollution of the environment.

It is an object of the present invention to provide an automatic shut-off nozzle for use in a non-overflow liquid delivery system, which is part of a portable fuel transfer system, and which nozzle is cost effective to manufacture.

SUMMARY OF THE INVENTION

In accordance with one aspect of the present invention there is disclosed a novel automatic shut-off nozzle for use in a non-overflow liquid delivery system for delivering liquid into a destination container, and recovering excess liquid from the destination container. The automatic shut-off nozzle comprises a liquid delivery conduit having a liquid-receiving inlet and a liquid-dispensing outlet interconnected one with the other in fluid communication by a liquid delivery through-passage. A liquid recovery conduit has a liquid-receiving inlet and a liquid-conveying outlet interconnected one with the other in fluid communication by a liquid recovery through-passage, and has a sensor retaining portion. A valve has a first movable valve portion disposed in the liquid delivery conduit and is movable between a valve closed position whereat liquid is precluded from being dispensed from the liquid-dispensing outlet of the liquid delivery conduit and a valve open position whereat liquid is permitted to be dispensed from the liquid-dispensing outlet of the liquid delivery conduit. A manually operable valve control mechanism is reconfigurable between an operating configuration whereat force can be transmitted by the valve control mechanism to the valve to thereby move the first movable valve portion to the valve open position, and a non-operating configuration whereat force cannot be transmitted by the valve control mechanism to the valve. A liquid sensor is disposed within the sensor retaining portion of the liquid-recovery conduit, and has a rest state and an actuated state whereat the liquid sensor reconfigures the valve control mechanism from the operating configuration to the non-operating configuration. The liquid sensor is responsive to a threshold condition of liquid in the sensor retaining portion of the liquid recovery conduit, to thereby cause the liquid sensor to be in its actuated state.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described herein below.

BRIEF DESCRIPTION OF THE DRAWINGS

The novel features which are believed to be characteristic of the automatic shut-off nozzle according to the present invention, as to its structure, organization, use and method of operation, together with further objectives and advantages thereof, will be better understood from the following drawings in which a presently first preferred embodiment of the invention will now be illustrated by way of example. It is expressly understood, however, that the drawings are for the purpose of illustration and description only, and are not intended as a definition of the limits of the invention. In the accompanying drawings.

DETAILED DESCRIPTION OF THE PREFERRED EMBODIMENTS

Figure 12:
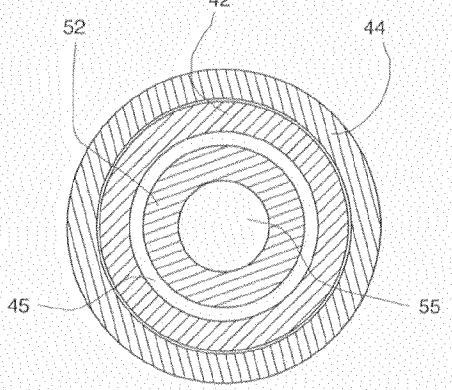
FIG. 12 is a cross-sectional front elevational view of the first preferred embodiment nozzle of FIG. 2, taken along section line 12-12 of FIG. 8, showing the minimum effective internal cross-sectional area of the liquid delivery through-passage.
Figure 13:
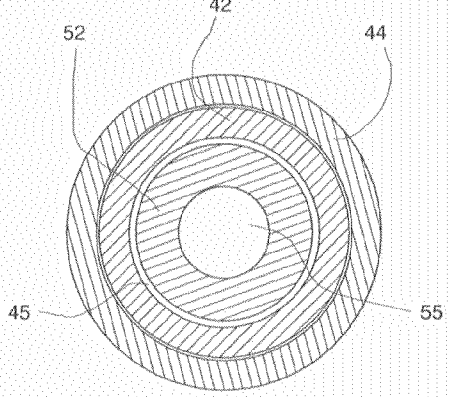
FIG. 13 is a cross-sectional front elevational view similar to FIG. 12, but showing the second preferred embodiment nozzle according to the present invention.
Figure 14:
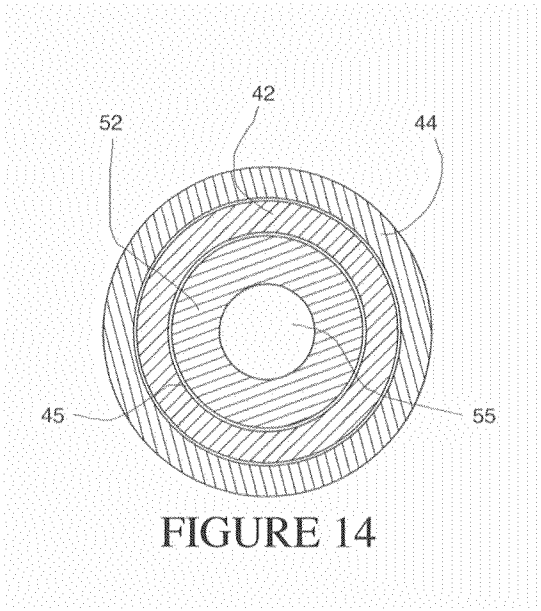
FIG. 14 is a cross-sectional front elevational view similar to FIG. 12, but showing the third preferred embodiment nozzle according to the present invention; and, FIG. 15 is a cross-sectional side elevational view similar to FIG. 9, and showing excess liquid being suctioned up the liquid recovery conduit.
Figure 15:
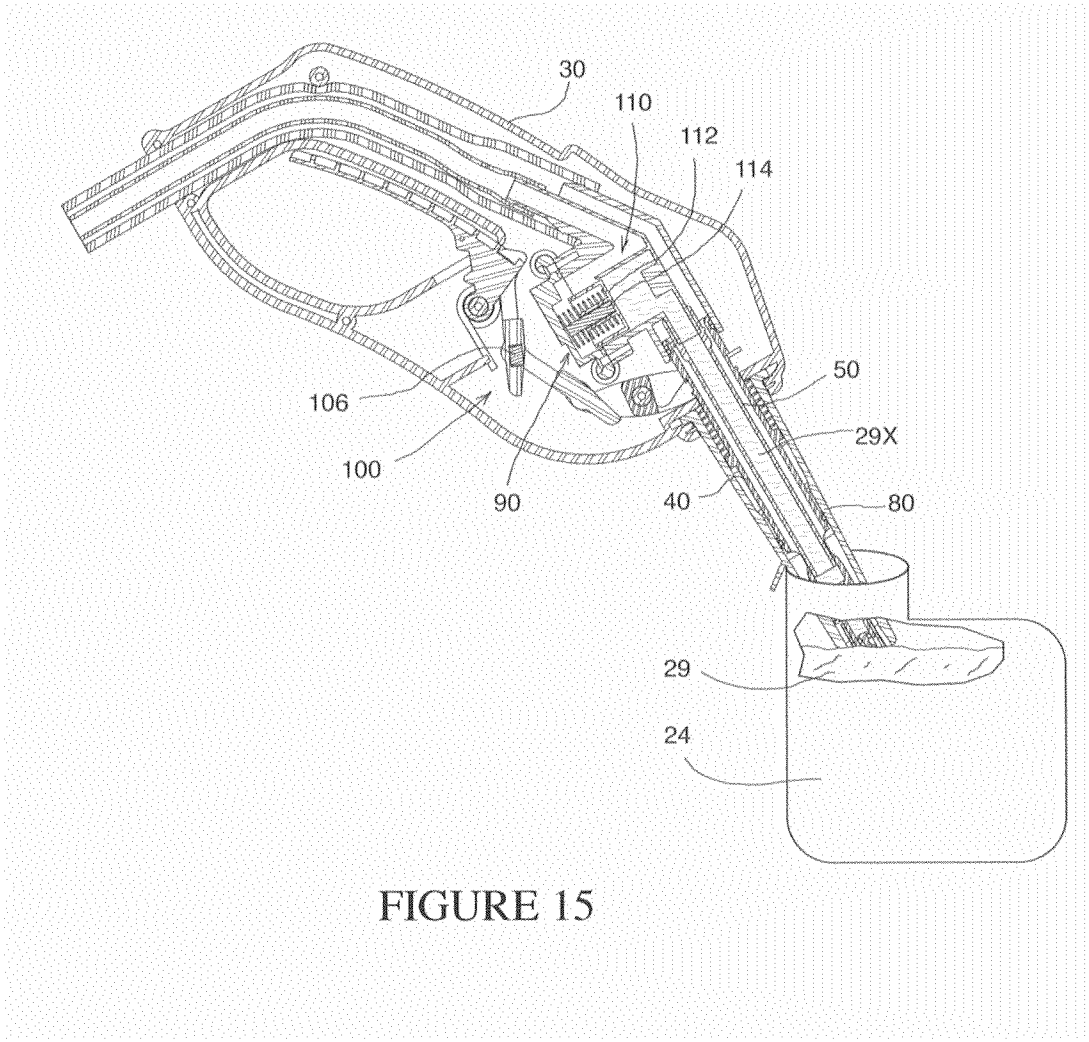

Referring to FIGS. 1 through 15 of the drawings, it will be noted that FIGS. 1 through 12 and 15 illustrate a first preferred embodiment of the nozzle of the present invention, FIG. 13 illustrates a second preferred embodiment of the nozzle of the present invention, and FIG. 14 illustrate a third preferred embodiment of the nozzle of the present invention.

Figure 1:
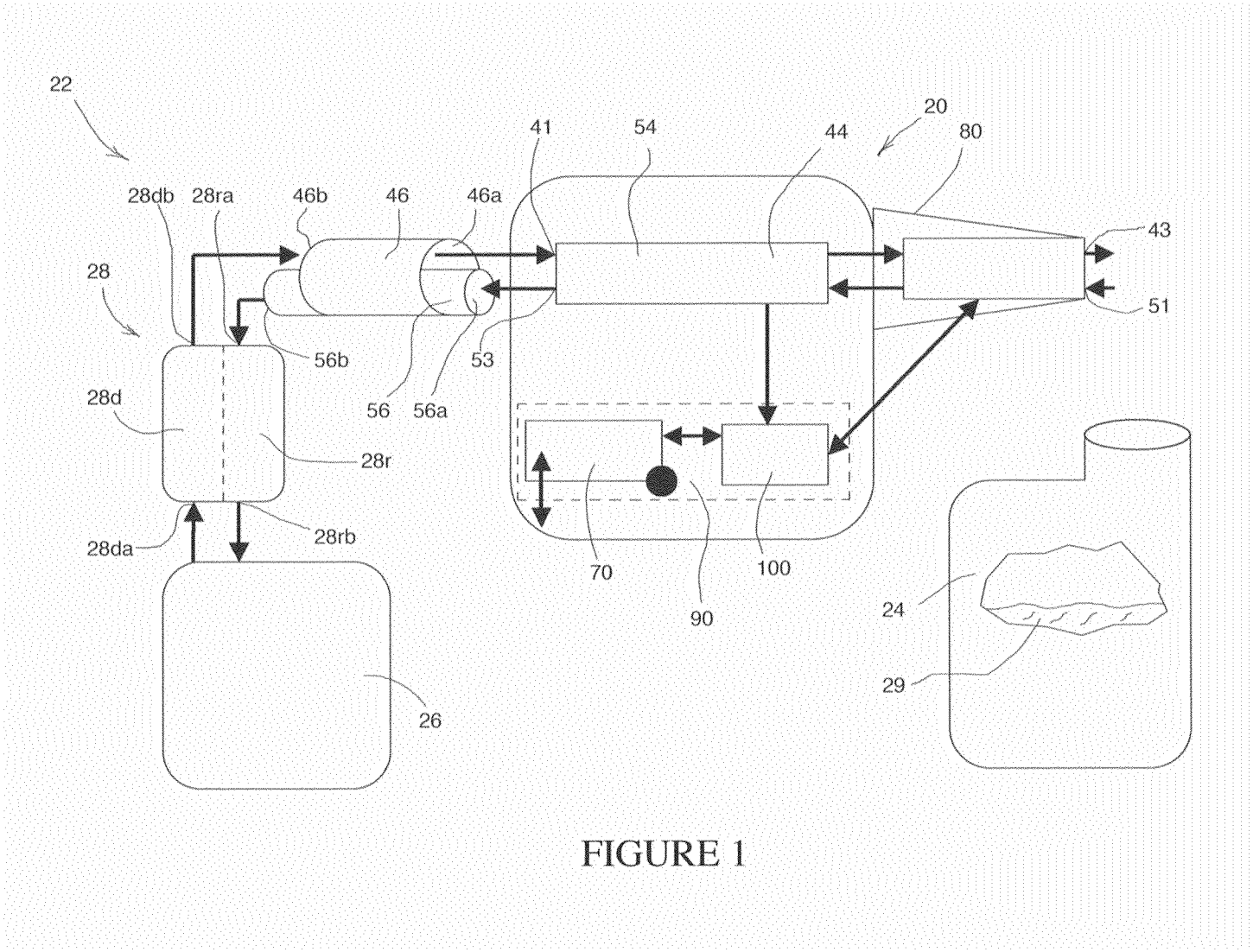
FIG. 1 is a block diagrammatic view of the first preferred embodiment of the nozzle according to the present invention.
Figure 2:
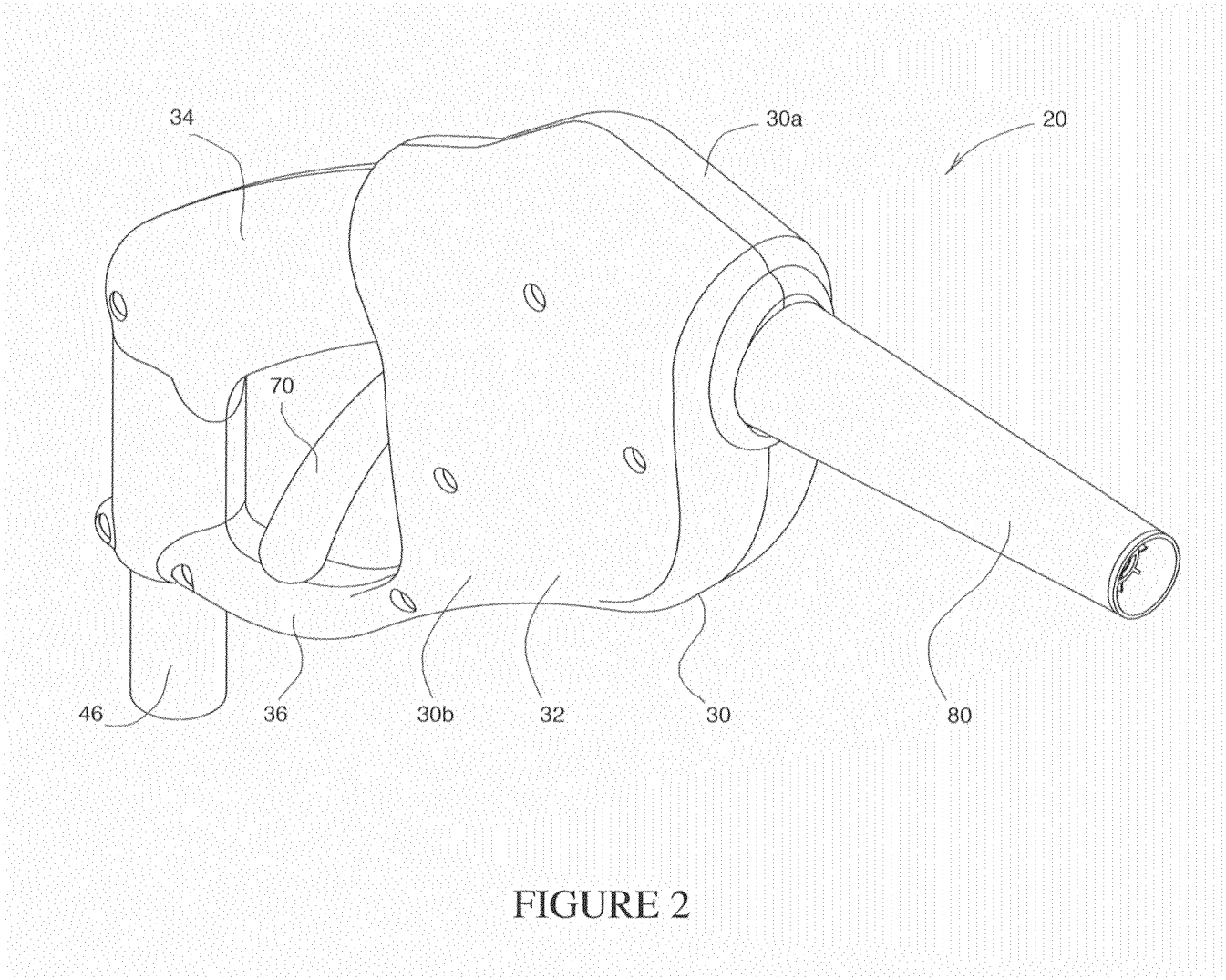
FIG. 2 is a perspective view from the front of the first preferred embodiment of the nozzle according to the present invention.
Figure 3:
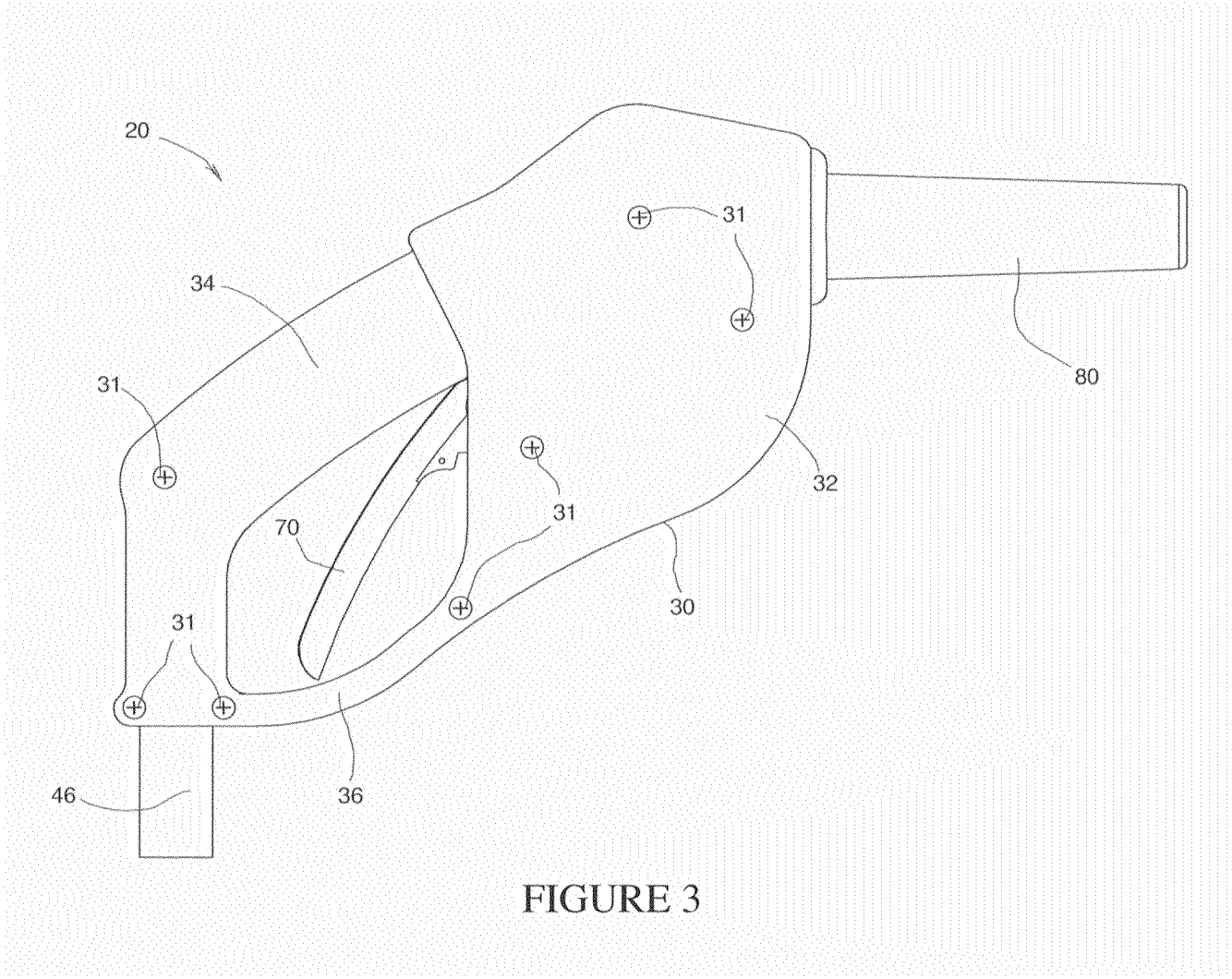
FIG. 3 is a side elevational view of the first preferred embodiment nozzle of FIG. 2.
Figure 4:
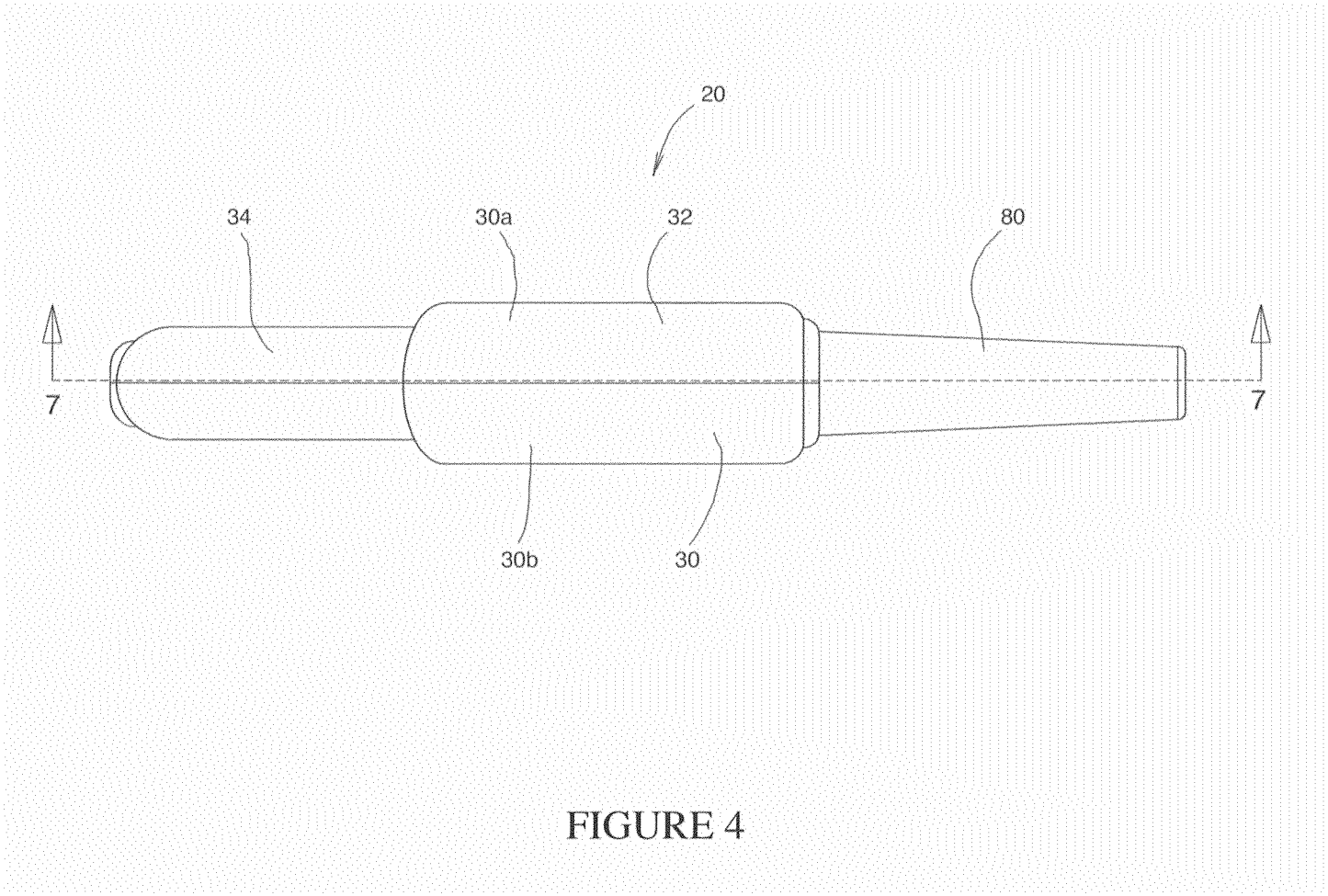
FIG. 4 is a top plan view of the first preferred embodiment nozzle of FIG. 2.
Figure 5:
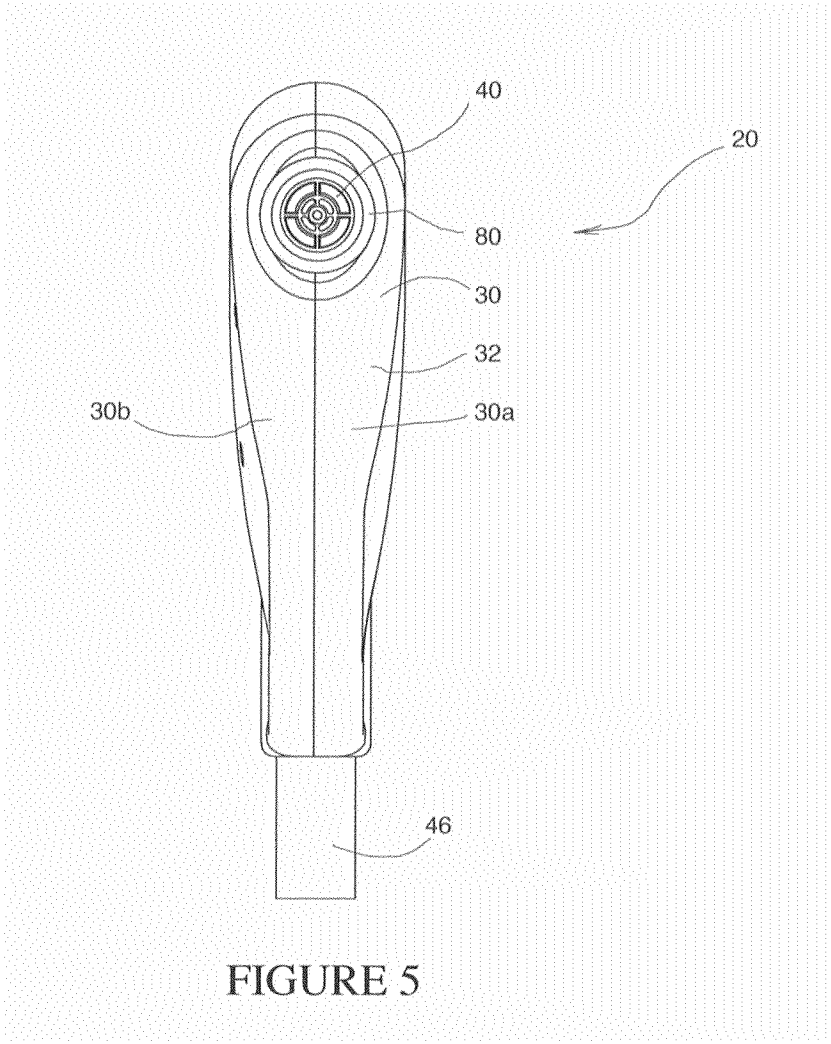
FIG. 5 is a front end view of the first preferred embodiment nozzle of FIG. 2.
Figure 6:
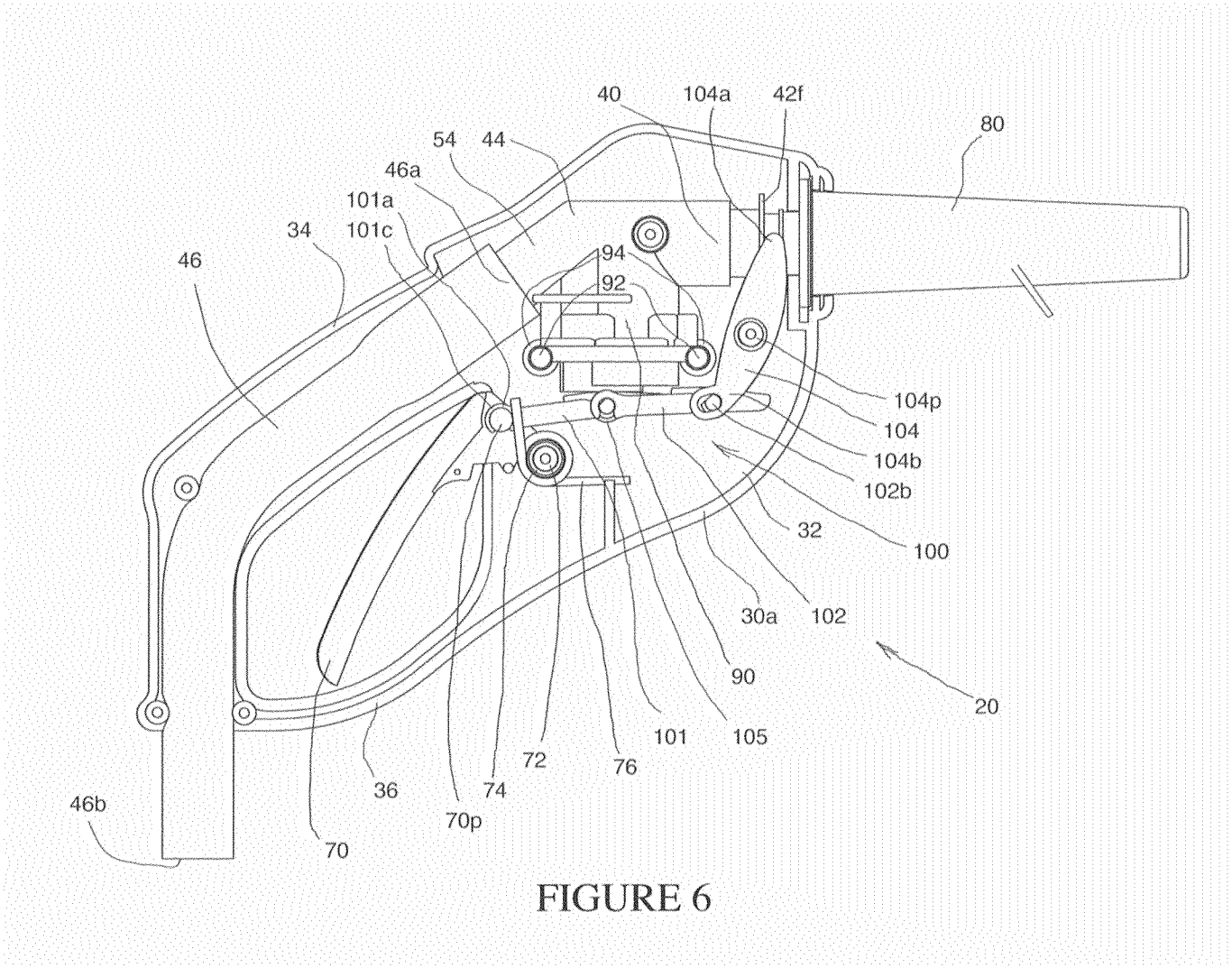
FIG. 6 is a side elevational view of the first preferred embodiment nozzle of FIG. 2, with the right side of the nozzle body removed for the sake of clarity.

Reference will now be made to FIGS. 1 through 12 and 15, which show a first preferred embodiment of the automatic shut-off nozzle 20 according to the present invention. The automatic shut-off nozzle 20 is for use in a non-overflow liquid delivery system, as shown in FIG. 1 by general reference numeral 22, for delivering liquid into a destination container 24, and recovering excess liquid 29*x* (see FIG. 15) from the destination container 24. Typically, the liquid is stored in a source container 26, such as a portable fuel container, also known as a portable gas can, and so. In brief, the first preferred embodiment automatic shut-off nozzle 20 according to the present invention comprises a nozzle body 30, a liquid delivery conduit 40, a liquid recovery conduit 50, an openable and closable valve 60, a manually operable trigger 70, a spout 80, a manually operable valve control mechanism 90, and a liquid sensor 110.

The first preferred embodiment automatic shut-off nozzle 20 will now be described in detail with reference to the figures. The nozzle 20 comprises a nozzle body 30 made from a suitable robust plastic material, such as PVC, HDPE, Nylon™, and so on, and molded in a left half 30*a* and a right half 30*b* secured together by suitable threaded fasteners 31 or any other suitable means. Alternatively, the nozzle could be diecast in zinc, aluminum, or the like. In the sectional views, specifically FIGS. 7, 8 and 9, only the left half 30*b* is shown. The nozzle body 30 has a main body portion 32, a rear handle portion 34, and a lower trigger protector portion 36. The manually operable trigger 70 is operatively disposed between the rear handle portion 34 and the lower trigger protector portion 36. In use, a user's hand would generally surround the rear handle portion 34 and the user's fingers would pull the manually operable trigger 70 towards the rear handle portion 34 to permit the flow of liquid from the nozzle 20.

The liquid delivery conduit 40 is carried by the nozzle body 30. More specifically, the liquid delivery conduit 40 comprises a substantially straight member 42 and an angled rear member 44 that inserts over a cooperating back end portion of the substantially straight member 42. The liquid delivery conduit 40 has a liquid-receiving inlet 41 disposed at the back end of the liquid delivery conduit 40, and more specifically at the back end of the angled rear member 44, and a liquid-dispensing outlet 43 disposed at the front end of the liquid delivery conduit 40, and more specifically at the front and of the substantially straight member 42. The liquid-receiving inlet 41 and the liquid-dispensing outlet 43 are interconnected one with the other in fluid communication by a liquid delivery throughpassage 45, such that liquid entering the liquid delivery conduit 40 at the liquid-receiving inlet 41 may be dispensed from the liquid-dispensing outlet 43 of the liquid delivery conduit 40.

A liquid recovery conduit 50 is also carried by the nozzle body 30. More specifically, the liquid recovery conduit 50 comprises a substantially straight member 52 and an angled rear member 54 that inserts into a cooperating enlarged back end portion of the substantially straight member 52. The liquid recovery conduit 50 also has a sensor retaining portion 58 disposed in the angled rear member 54, immediately forwardly of the overall change in angle of the angled rear member 54.

The liquid recovery conduit 50 has a liquid-receiving inlet 51 disposed at the front end of the liquid recovery conduit 50, and more specifically at the front end of the substantially straight member 52, and a liquid-conveying outlet 53 disposed at the back end of the liquid recovery conduit 50, and more specifically at the back end of the angled rear member 54. The liquid-receiving inlet 51 and the liquid-conveying outlet 53 are interconnected one with the other in fluid communication by a liquid recovery throughpassage 55, such that liquid entering the liquid recovery conduit 50 at the liquid-receiving inlet 51 may be conveyed from the liquid-conveying outlet 53 of the liquid recovery conduit 50, to the pump apparatus 28, and then to the source container 26.

The liquid recovery conduit 50 further comprises a spout portion 57 generally disposed within the spout 80. The sensor retaining portion 58 is disposed between the spout portion 57 and the liquid-conveying outlet 53. Preferably, but not necessarily, the sensor retaining portion 58 of the liquid recovery conduit 50 is oriented generally transversely to the spout portion 57 of the liquid recovery conduit 50, partially due to space considerations and partly to enable it to interact with the linkage mechanism 100.

Figure 7:
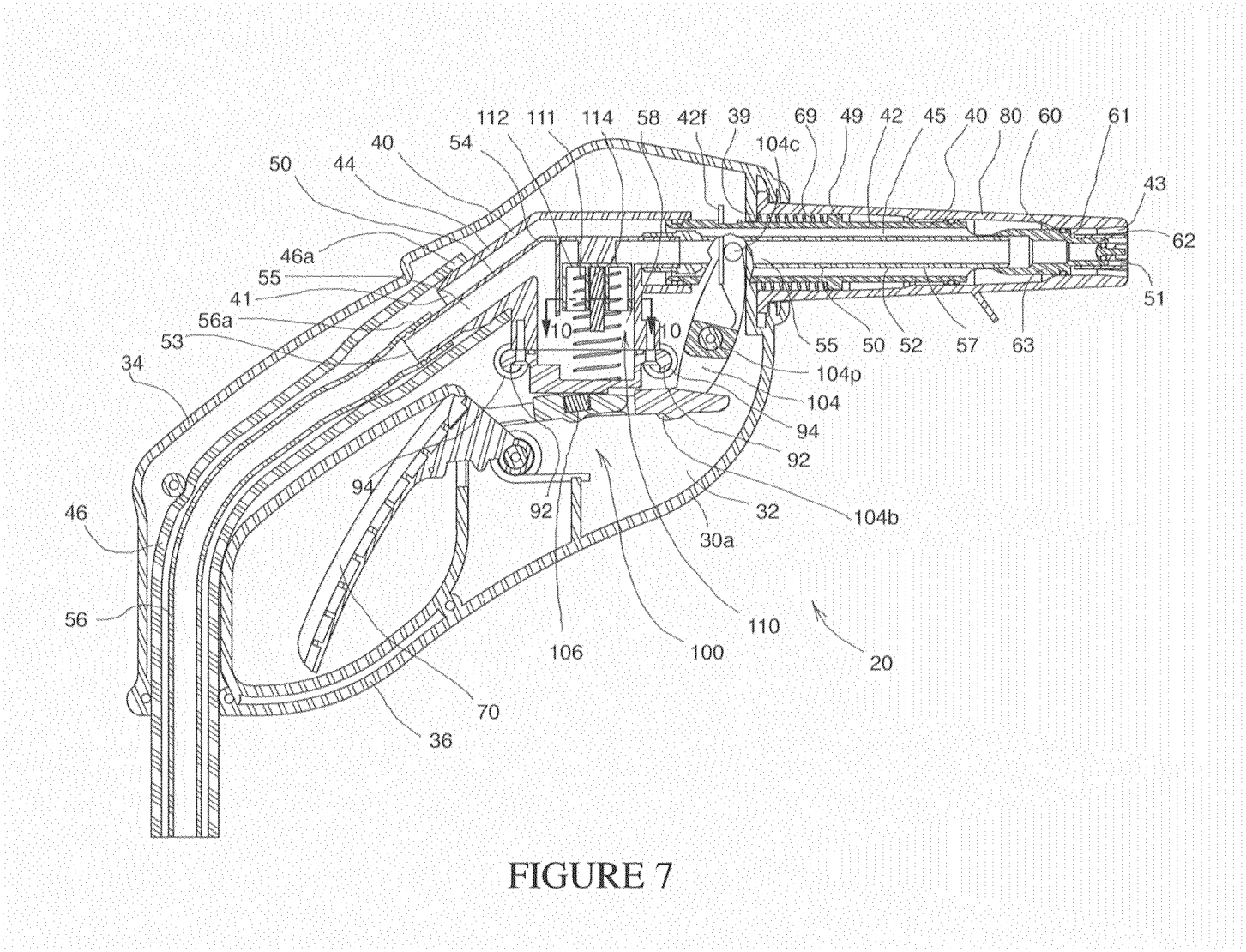
FIG. 7 is a cross-sectional side elevational view of the first preferred embodiment nozzle of FIG. 2, taken along section line 7-7 of FIG. 4, with the first movable valve portion in a valve-closed position, the manually operable trigger in a rest position, and the linkage mechanism in an operating configuration.
Figure 8:
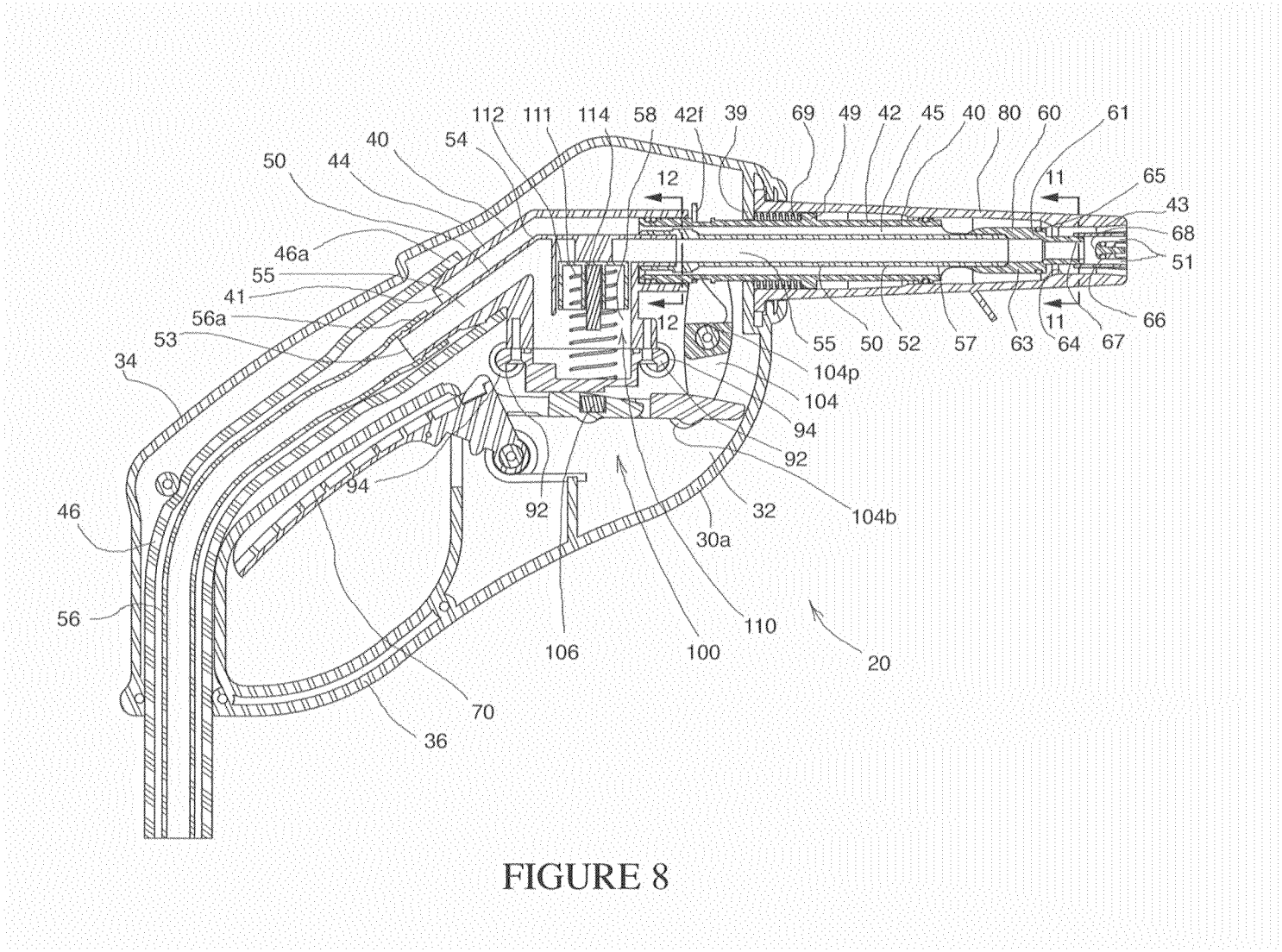
FIG. 8 is a cross-sectional side elevational view similar to FIG. 7, but with the first movable valve portion in a valve-open position and the manually operable trigger in an in-use position.
Figure 9:
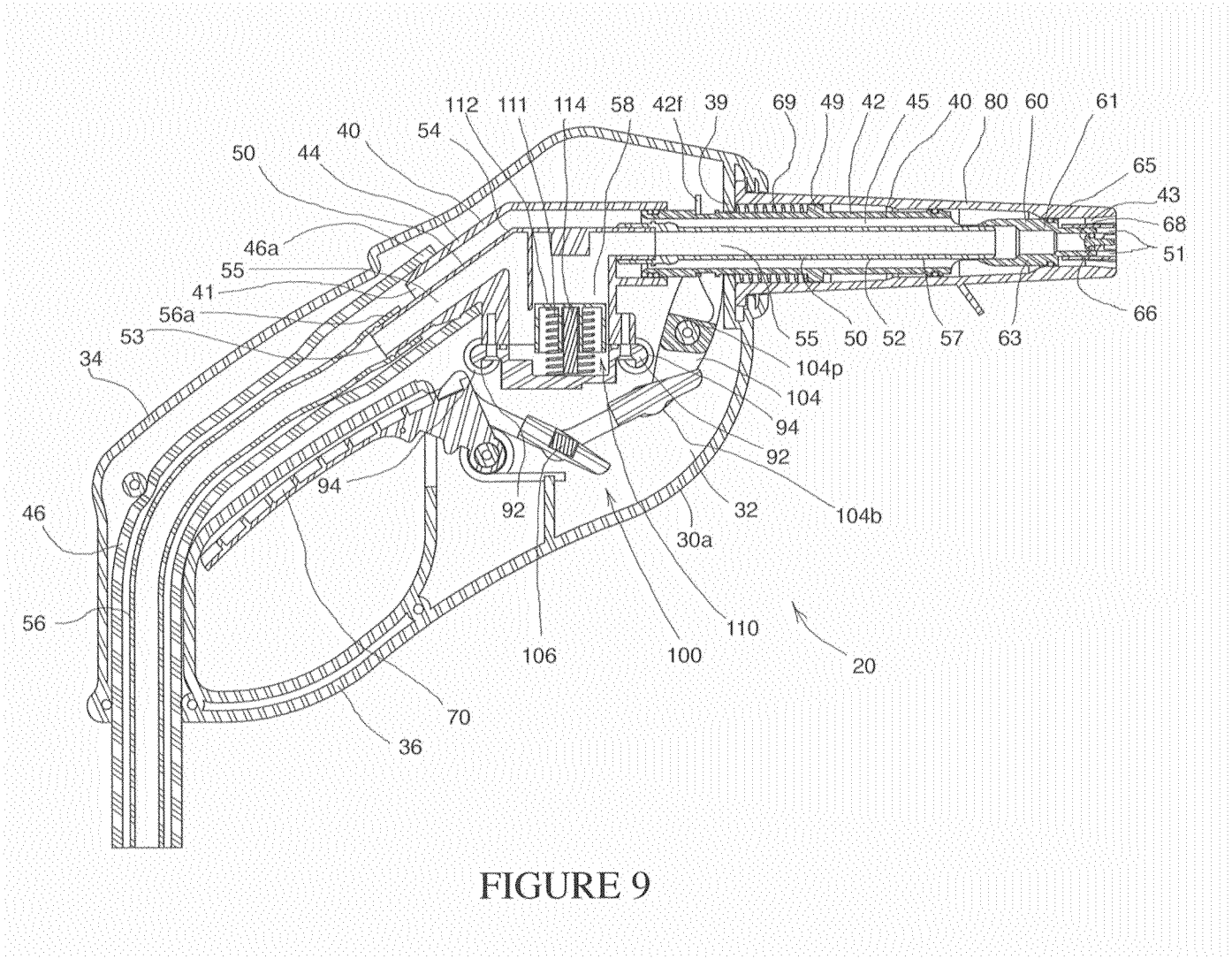
FIG. 9 is a cross-sectional side elevational view similar to FIG. 8, but with the first movable valve portion in a valve-closed position and the manually operable valve control mechanism (specifically the linkage mechanism) in an non-operating configuration.

As can be best seen in FIGS. 7, 8 and 9, the angled rear member 44 of the liquid delivery conduit 40 and the angled rear member 54 of the liquid recovery conduit 50 are formed together. The angled rear member 44 of the liquid delivery conduit 40 and the angled rear member 54 of the liquid recovery conduit 50 are combined in this manner for the purpose of readily fitting these parts into a small space while realizing the necessary design requirements, and also to provide a structural base portion for mounting the angled rear member 44 of the liquid delivery conduit 40 and the angled rear member 54 of the liquid recovery conduit 50 on to the nozzle body 30 via posts 92 that fit into cooperating apertures 94 in the nozzle body 30.

A flexible liquid delivery hose 46 is secured at a first end 46*a* to the liquid-receiving inlet 41 at the back end of the angled rear member 44 of the liquid delivery conduit 40, to be in fluid communication with the liquid delivery throughpassage 45 of the liquid delivery conduit 40. As can be seen in FIGS. 7, 8 and 9, since the angled rear member 44 of the liquid delivery conduit 40 is formed together with the angled rear member 54 of the liquid recovery conduit 50, the back portion of the angled rear member 44 of the liquid delivery conduit 40 and the back portion of the angled rear member 54 of the liquid recovery conduit 50 are not concentric one with the other, and are partially formed one with the other.

The opposite second end 46*b* of the flexible liquid delivery hose 46 is connectable to the outlet 28*db* of a liquid delivery pump 28*d*, which is part of the overall pump apparatus 28, for receiving liquid from the liquid delivery pump 28*d*. The liquid in the liquid delivery pump 28*d* is drawn by the liquid delivery pump 28*d* from the source container 26 into the inlet 28*da* of the liquid delivery pump 28*d*. In essence, the liquid delivery pump 28*d* draws liquid from the source container 26 and pumps it through the liquid delivery hose 46 and through the liquid delivery conduit 40 of the nozzle 20, to be delivered from the liquid-dispensing outlet 43 and into the destination container 24.

A flexible liquid recovery hose 56 is secured at its first end 56*a* to the liquid-conveying outlet 53 at the back end of the angled rear member 54 of the liquid recovery conduit 50, to be in fluid communication with the liquid recovery throughpassage 55 of the liquid recovery conduit 50. The opposite second end 56*b* of the flexible liquid recovery hose 56 is connectable to a liquid recovery pump 28*r*, which is part of the overall pump apparatus 28. The liquid recovery pump 28*r* is for pumping the excess liquid 29*x* recovered from the destination container 24 back to the source container 26. The opposite second end 56*b* of the flexible liquid recovery hose 56 is connectable to the inlet 28*ra* of the liquid recovery pump 28*r* for receiving liquid from the liquid recovery hose 56.

The liquid recovery pumping portion 28*r* draws liquid in from the destination container 24, once the liquid 29 in the destination container 24 has risen to cover the liquid-receiving inlet 51 at the tip of the spout 80. The liquid is then drawn in through the liquid-receiving inlet 51 of the liquid recovery conduit 50. The recovered liquid is conveyed through the liquid recovery conduit 50 and the liquid recovery hose 56 to the inlet 28*ra* of the liquid recovery pump 28*r* which pumps the recovered liquid from outlet 28*rb* into the source container 26.

In the first preferred embodiment, as illustrated, a portion of the liquid delivery conduit 40, specifically the substantially straight member 42, is carried by the spout 80 for insertion into the destination container 24. Similarly, a portion of the liquid recovery conduit 50, specifically the substantially straight member 42, is carried by the spout 80 for insertion into the destination container 24.

Also, in the first preferred embodiment, as illustrated, the liquid recovery conduit 50 is generally disposed within the liquid delivery conduit 40. The purposes of this are to permit the liquid recovery conduit 50 to be protected by the liquid delivery conduit 40, thus allowing it to be made from a less robust, and therefore less expensive material, and also to take up less space in the nozzle body 30 and the spout 80.

Figure 11:
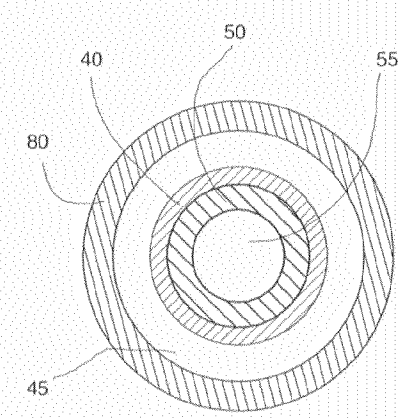
FIG. 11 is a cross-sectional front elevational view of the first preferred embodiment nozzle of FIG. 2, taken along section line 11-11 of FIG. 8, showing the minimum effective internal cross-sectional area of the liquid recovery through-passage.

As can be best seen in FIGS. 11 and 12, the minimum effective internal cross-sectional area of the liquid recovery throughpassage 55 is equal to or greater than half the minimum effective internal cross-sectional area of the liquid delivery throughpassage 45. This ratio of the minimum effective internal cross-sectional areas ensures that the liquid recovery conduit 50 will have the volumetric capacity to readily permit the recovery of substantially the same volume of liquid per unit time as the liquid delivery conduit 40, without undue resistance to flow. It has been found in experimentation that having the minimum effective internal cross-sectional area of the liquid recovery throughpassage 55 greater than half the minimum effective internal cross-sectional area of the liquid delivery throughpassage 45 provides for ready and reliable recovery of excess liquid from the destination container 24, especially at low volumetric rates, corresponding to slow pumping speeds.

Further, as shown in FIG. 11 and in FIG. 13 (which shows the second preferred embodiment of the present invention), the minimum effective internal cross-sectional area of the liquid recovery throughpassage 55 is equal to or greater than the minimum effective internal cross-sectional area of the liquid delivery throughpassage 45. It has been found in experimentation that having the minimum effective internal cross-sectional area of the liquid recovery throughpassage 55 roughly equal to or slightly greater than the minimum effective internal cross-sectional area of the liquid delivery throughpassage 45 is appropriate for transferring liquid via a non-reciprocating pump, where the flow of liquid being delivered and the flow of liquid being recovered is substantially constant.

Further, liquid recovery conduit 50 is preferably non-bifurcated such that the flow of liquid through the liquid recovery conduit 50 is not hampered by unnecessary resistance due to change in the direction of the liquid recovery conduit 50 or unnecessary narrowing of portions of the liquid recovery conduit 50, thereby eliminating resistance to the flow of liquid and achieving the most effective recovery of excess liquid 29*x*.

Also, as shown in FIG. 11 and in FIG. 14 (which shows the third preferred embodiment of the present invention), the minimum effective internal cross-sectional area of the liquid recovery throughpassage 55 is equal to or greater than twice the minimum effective internal cross-sectional area of the liquid delivery throughpassage 45. When a reciprocating pump is being used this ratio of the minimum effective internal cross-sectional areas ensures that the liquid recovery conduit 50 will have the volumetric capacity to readily permit the recovery of substantially the same volume of liquid per unit time as the liquid delivery conduit 40. It has been found in experimentation that having the minimum effective internal cross-sectional area of the liquid recovery throughpassage 55 roughly equal to or even greater than twice the minimum effective internal cross-sectional area of the liquid delivery throughpassage 45 is useful in controlling the balance of flow rates of liquid being delivered from the liquid-dispensing outlet 43 of the liquid delivery conduit 40 and the liquid being recovered by the liquid receiving inlet 51 of the liquid conduit 50, while maintaining ready and full capacity of the liquid recovery function through the liquid recovery conduit 50. This is important in the situation where the spout 80 of the nozzle is inserted into a relatively narrow diameter portion of a destination container, such as the fill pipe of the fuel tank of a vehicle. This narrow diameter is typically only slightly greater than the diameter of the spout 80 of the nozzle 20. The peripheral volume of air between the spout 80 and the fill pipe (not specifically shown), above the vapor inlet of the spout 80, is quite small. With the present invention, the flow of fuel is extremely unlikely to fill this peripheral volume and subsequently overflow the fill pipe.

It has been found in experimentation that the recovery of liquid is delayed due to the expansion of vapor in the liquid recovery conduit 50, which creates an imbalance between the liquid being delivered and the liquid being recovered. This delay can be mitigated by having a liquid recovery throughpassage 55 with a minimum effective internal cross-sectional area that is significantly greater than the minimum effective internal cross-sectional area of the liquid delivery throughpassage 45. More specifically, it has been found that having a liquid recovery throughpassage 55 with a minimum effective internal cross-sectional area that is about twice, or even more than twice, the minimum effective internal cross-sectional area of the liquid delivery throughpassage 45, is effective in balancing the ongoing delays in the recovery of liquid into the liquid recovery conduit 50. It should be understood that this means of balancing these delays apply only to liquid delivery system that employs a reciprocating style pump.

The smaller minimum effective internal cross-sectional area of the liquid delivery passage 45 creates a back pressure in the liquid delivery hose 46, which causes the liquid delivery hose 46 to expand a bit each time the liquid delivery pump 28*d* is pumped. Accordingly, a portion of the liquid pumped by each stroke is buffered by the expansion of the liquid delivery hose 46. This extra volume of liquid is quickly dissipated into the destination container 24 during the return stroke of the liquid delivery pump 28*d*. This buffering provides a delay in the delivery of that liquid, which corresponds to the delay in the recovery of liquid caused by the expansion of vapor in the liquid recovery conduit.

As can readily be seen in FIGS. 7, 8 and 9, the liquid-dispensing outlet 43 of the liquid delivery conduit 40 and the liquid-receiving inlet 51 of the liquid recovery conduit 50 are disposed adjacent each other. Although this juxtaposition of liquid-dispensing outlet 43 of the liquid delivery conduit 40 and the liquid-receiving inlet 51 of the liquid recovery conduit 50 is not necessary, it has been found to be useful for effective placement of the liquid-receiving inlet 41 in establishing a "non-overflow" elevation for a destination container 24.

The nozzle 20 according to the present invention further comprises an openable and closable valve 60 that is shown in FIGS. 7, 8 and 9, to be mounted on the front end of the substantially straight member 42 of the liquid delivery conduit 40. The operable and closable valve 60 is basically a flow control valve.

The openable and closable valve 60 comprises a first movable valve portion 61 disposed in the liquid delivery conduit 40, and selectively movable between a valve-closed position, as best seen in FIGS. 7 and 9, and a valve-open position, as best seen in FIG. 8. In the valve-closed position, liquid 29 is precluded from being dispensed from the liquid-dispensing outlet 43 of the liquid delivery conduit 40. In the valve-open position, liquid 29 is permitted to be dispensed from the liquid delivery conduit 40, as will be discussed in greater detail subsequently.

The openable and closable valve 60 further comprises a second movable valve portion 62 disposed in the liquid recovery conduit 50, and selectively movable between a valve-closed position, as best seen in FIGS. 7 and 9, and a valve-open position, as best seen in FIG. 8. In the valve-closed position, liquid 29 is precluded from being recovered by the liquid-receiving inlet 51 of the liquid recovery conduit 50. In the valve-open position, liquid is permitted to be recovered by the liquid recovery conduit 50, as will be discussed in greater detail subsequently.

More specifically, the valve 60 comprises a substantially cylindrical central main body portion 63 that is securely connected to the front end of the substantially straight member 42 of the liquid delivery conduit 40 for longitudinal sliding movement therewith. The first movable valve portion 61 and the second movable valve portion 62 extend forwardly from the main body portion 63.

In the first preferred embodiment, as illustrated, the first movable valve portion 61 and the second movable valve portion 62 are interconnected one to the other for co-operative movement one with the other. More specifically, the first movable valve portion 61 and the second movable valve portion 62 are interconnected one to the other for concurrent movement one with the other. Even more specifically, the first movable valve portion 61 and the second movable valve portion 62 are integrally formed one with the other for concurrent movement one with the other.

The first movable valve portion 61 comprises a cylindrically shaped flange with an "O"-ring gland that carries an "O"-ring 65 on its outer periphery. The "O"-ring 65 seals against a co-operating receiving surface 64 adjacent the front end of the spout 80. As can be seen in FIGS. 7, 8 and 9, the first movable valve portion 61 is disposed adjacent the liquid-dispensing outlet 43 of the liquid delivery conduit 40. Accordingly, there is very little distance between the first movable valve portion 61 and the front end of the spout 80, and thus only a very small volume for liquid to be retained in the spout 80 when the first movable valve portion 61 is in its valve-closed position, thereby precluding any significant dripping and draining of liquid after the first movable valve portion 61 has been moved to its valve-closed position.

The second movable valve portion 62 comprises a cylindrically shaped flange that is concentric with the first movable valve portion 61 and disposed therewithin. Unlike the first movable valve portion 61, but analogous thereto in a functional sense, the second movable valve portion 62 does not carry an "O"-ring. Instead, the second movable valve portion 62 engages a cooperating "O"-ring 66 disposed within an "O"-ring gland on a central plug 68, which seals against inner surface 67 of the second movable valve portion 62. As can be seen in FIGS. 7, 8 and 9, the second movable valve portion 62 is disposed adjacent the liquid-receiving inlet 51 of the liquid recovery conduit 50. Accordingly, there is very little distance between the second movable valve portion 62 and the front end of the spout 80, and thus only a very small volume for liquid to be retained in the spout 80 when the second movable valve portion 62 is in its valve-closed position, thereby precluding any significant dripping and drainage of liquid after the second movable valve portion 62 has been moved to its valve-closed position.

The nozzle 20 further comprises a spring 69 for biasing the valve 60 to the valve-closed position. The spring 69 is retained in compressed relation between an inwardly directed annular flange 39 within the interior of the nozzle body 30 at the front end thereof, and an outwardly directed annular flange 49 on the liquid delivery conduit 40.

It should be noted that the above discussion regarding relative minimum cross-sectional areas of liquid delivery conduit 40 and the liquid recovery conduit 50 is based on the first movable valve portion 61 and the second movable valve portion 62 being in their valve-open positions.

A manually operable valve control mechanism 90 is reconfigurable between an operating configuration, as can be best seen in FIGS. 7 and 8, and a non-operating configuration, as can be best seen in FIG. 9. In the operating configuration, force can be transmitted by the valve control mechanism 90 to the first movable valve portion 61 of the valve 60, to thereby move the first movable valve portion 61 to the valve-open position. In the non-operating configuration, force cannot be transmitted by the valve control mechanism 90 to the first movable valve portion 61 of the valve 60. Accordingly, the first movable valve portion 61 is biased by the spring 69 to the valve-closed position.

Also, the manually operable valve control mechanism 90 further comprises the manually operable trigger 70 for moving the first movable valve portion 61 of the valve 60 to the valve open position. The manually operable trigger 70 is movable between a rest position, as is shown in FIG. 7, and at least one in-use position, as is shown in FIGS. 8 and 9. The trigger 70 is movable by the fingers of the user's hand that is used to operatively grip the rear handle portion 34.

More specifically, the manually operable trigger 70 is pivotally mounted on the nozzle body 30 via a pivot post 72 that extends through a cooperating circular aperture 74 in the front portion of the trigger 70. A torsion spring 76 biases the manually operable trigger 70 to its rest position.

The manually operable valve control mechanism 90 further comprises a linkage mechanism 100 operatively connecting the manually operable trigger 70 and the valve 60. The manually operable trigger 70 is operatively connected to the valve 60 for permitting selective operation of the valve 60, and more particularly the first movable valve portion 61, between the valve-closed position and the valve-open position, and particularly to the valve-open position.

The linkage mechanism 100 comprises a generally horizontally disposed first link arm 101, a generally horizontally disposed second link arm 102, and a generally vertically disposed pusher link arm 104. The first link arm 101 and the second link arm 102 are connected one to the other in angularly variable relation at a linkage elbow 105. More specifically, the first link arm 101 and the second link arm 102 are connected one to the other in pivotal relation at the linkage elbow 105. The first link arm 101 is also connected at its back end 101*a* to the manually operable trigger 70 in pivotal relation by means of a clasp 101*c* engaged onto a post 70*p*.

As can readily be seen in FIGS. 7 through 9, the first link arm 101 and the second link arm 102 form an over-the-center type mechanism. When the valve control mechanism 90 is in its operating configuration, as shown in FIGS. 7 and 8, the first link arm 101 and the second link arm 102 can transmit force from the manually operable trigger 70 to the generally vertically disposed pusher link arm 104, and thus to the valve 60, thereby permitting operation of the valve 60. When the valve control mechanism 90 is in its non-operating configuration, as shown in FIG. 9, the first link arm 101 and the second link arm 102 cannot transmit force from the manually operable trigger 70 to the generally vertically disposed pusher link arm 104, and thus to the valve 60, thereby precluding operation of the valve 60.

The generally vertically disposed pusher link arm 104 is pivotally mounted on a pivot post 104*p* on the nozzle body 30, and has an upper portion 104*a* and a lower portion 104*b*. The upper portion 104*a* has an integrally molded stud 104*c* that engages a forward facing surface 42*f* on the substantially straight member 42 of the liquid delivery conduit 40.

The horizontally disposed second link arm 102 is pivotally connected at an opposite second end 102*b* to the lower portion 104*b* of the generally vertically disposed pusher link arm 104. In this manner, the pusher link arm 104 and the second link arm 102 are connected one to the other in angularly variable relation. The generally vertically disposed pusher link arm 104 is operatively interconnected between the manually operable trigger 70 and the valve 60, and more particularly between the second link arm 102 and the valve 60, for transmitting force from the second link arm 102 to the valve 60, to thereby permit the first movable valve portion 61 of the valve 60 to be moved to the valve open position. When the manually operable trigger 70 is moved from its rest position, as shown in FIG. 7, to an in-use position, as shown in FIG. 8, the horizontally disposed arm 104 is pushed forwardly, thus rotating the generally vertically disposed pusher link arm 104 counterclockwise (as illustrated), thus moving the first movable valve portion 61 of the valve 60 from its valve-closed position to its valve-open position.

The linkage mechanism 100 also comprises a ferrous portion. More specifically, the ferrous portion comprises a linkage magnet 106 mounted on one of the first link arm 101 and the second link arm 102 for movement therewith. In the first preferred embodiment as illustrated, the linkage magnet 106 is mounted on the first link arm 101.

The automatic shut-off nozzle 20 further comprises a liquid sensor 110 disposed within the sensor retaining portion 58 of the liquid-recovery conduit 50, and has a rest state, as is shown in FIGS. 7 and 8, and an actuated state, as is shown in FIG. 9, whereat the liquid sensor 110 reconfigures the valve control mechanism 90 from the operating configuration to the non-operating configuration.

The liquid sensor 110 is responsive to a threshold condition of liquid in the sensor retaining portion 58 of the liquid recovery conduit 50, to thereby cause the liquid sensor 110 to be in its actuated state, and to thereby cause movement of the first movable valve portion 61 to the valve closed position. For instance, the liquid sensor 110 will generally be actuatable by a threshold force due to the pressure of excess liquid 29*x* against the liquid sensor 110. This threshold condition can be realized at various flow rates of the excess liquid 29*x*, various pressure differences across the liquid sensor 110 (in its direction of movement), and so on.

In the first preferred embodiment, as illustrated, the liquid sensor 110 comprises a piston 112 slidably mounted in the sensor retaining portion 58 of the liquid recovery conduit 50 for movement between a rest position, as can be best seen in FIGS. 7 and 8, corresponding to the rest state of the liquid sensor 110, and an actuated position, as can be best seen in FIG. 9, corresponding to the actuated state of the liquid sensor 110. A piston spring 111 spring biases the piston 112 to the rest position.

Figure 10:
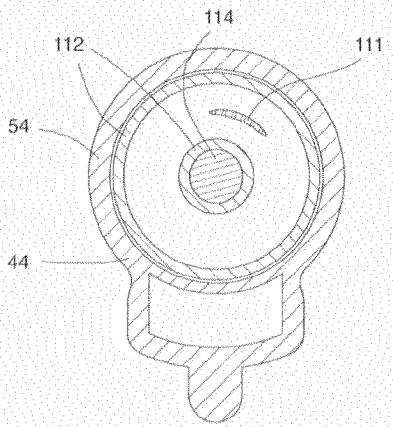
FIG. 10 is a cross-sectional front elevational view of the first preferred embodiment nozzle of FIG. 2, taken along section line 10-10 of FIG. 7, showing the liquid sensor piston and the area around the liquid sensor piston.

It should also be noted that there is another important aspect to the nozzle according to the present invention. In use, as liquid is being delivered into the destination container 24 from the liquid delivery conduit 40, vapor is being suctioned from the destination container 24 through the liquid recovery conduit 50. The suctioned flow of vapor by-passes the piston 112 by flowing around it, through the area between the piston 112 of the liquid sensor 110, as shown in FIG. 10, and the liquid recovery conduit 50 at the sensor retaining portion 58.

It has been found that the correct size of the area separating the sensor 110 and the sensor retaining portion 58 is especially important in refueling system where a manual pump is utilized. In a manual system the flow rate of fuel dispensed by the refueling system is dependent on the user. In situations where the user is pumping slowly, the flow rate of recovered liquid could be below the minimum threshold flow rate for moving the liquid sensor 110 to the actuated state. Accordingly, the liquid sensor 110 would not be actuated to close the valve 60 and stop the flow of fuel being dispensed from the liquid delivery conduit 40. The recovered liquid would instead freely flow around the liquid sensor 110 and continue to be recovered back to the source container 26. Accordingly the auto shut-off nozzle of the present invention can prevent spillage due to overflow by either automatically shutting off or by recovering excess liquid 29*x* as described above.

In order to accomplish this liquid recovery feature while maximizing the overall effectiveness and responsiveness of the automatic shut-off nozzle 20, a preferable range of sizes of the cross-sectional area separating the piston 112 of the liquid sensor 110 and the liquid recovery conduit 50 at the sensor retaining portion 58 has been found. This range has been determined to be between the minimum cross sectional area of the liquid recovery conduit 50 and the predominant cross-sectional area of the liquid delivery throughpassage 45 of the liquid recovery conduit 50. The predominant cross-sectional area of the liquid delivery throughpassage 45 of the liquid recovery conduit 50 is defined as the modal average of the cross-sectional area of the liquid delivery throughpassage 45 of the liquid recovery conduit 50, or in other words the most common cross-sectional area of the liquid delivery throughpassage 45 of the liquid recovery conduit 50.

The liquid sensor 110 further comprises a sensor magnet 114 operatively connected to the liquid sensor 110 for movement between a rest position corresponding to the rest position of the piston 112 and a link disabling position corresponding to the actuated position of the piston 112. In the link disabling position, the magnetic force from the sensor magnet 114 acts on the ferrous portion of the linkage mechanism 100, or in other words the linkage magnet 106, to move the linkage mechanism 100 to the non-operating configuration. The sensor magnet 114 is operatively connected to the piston 112 for movement therewith. More specifically, the sensor magnet 114 is mounted on the piston 112 for movement therewith. In the first preferred embodiment, the sensor magnet 114 is substantially cylindrical and fits within the hollow interior of the piston 112.

As can be readily seen in FIGS. 7 through 9, the sensor magnet 114 and the linkage magnet 106 are oriented such that the linkage magnet 106 is repelled by the sensor magnet 114 when the piston 112 is in the actuated position. This orientation may be either magnetic-north to magnetic-north, or magnetic-south to magnetic-south.

It should be noted that due to the incomplex design of the linkage mechanism 100, the manually operable trigger 70 is connected to both the first movable valve portion 61 and the second movable valve portion 62 for corresponding positive movement of the first movable valve portion 61 and the second valve portion 62 between their respective valve-closed positions and valve-open positions.

As can be understood from the above description and from the accompanying drawings, the present invention provides an auto shut-off nozzle for use in a non-overflow liquid delivery system, which nozzle is part of a portable fuel transfer system, is for use in a non-overflow liquid delivery system for delivering liquid into a destination container, and recovering excess liquid from the destination container, wherein, in use, the volume of liquid in the destination container stops increasing once liquid in the destination container covers the liquid-receiving inlet of the nozzle, which nozzle substantially eliminates spillage due to overflowing of liquid from the destination container, which nozzle will greatly reduce spillage due to dripping or drainage that can occur once the liquid transfer process is complete, wherein the flow control valve controls both the flow of liquid in the liquid delivery conduit and the flow of liquid in the liquid recovery conduit, wherein the flow control valve is located in the spout of the nozzle, wherein the flow control valve is located at the tip of the spout, which nozzle minimizes the chance of user error, and which nozzle is cost effective to manufacture, all of which features are unknown in the prior art.

Other variations of the above principles will be apparent to those who are knowledgeable in the field of the invention, and such variations are considered to be within the scope of the present invention. Further, other modifications and alterations may be used in the design and manufacture of the nozzle of the present invention without departing from the spirit and scope of the accompanying claims.

We claim:

1. An automatic shut off nozzle for use in a non overflow liquid delivery system for delivering liquid into a destination container, and recovering excess liquid from said destination container, said automatic shut off nozzle comprising:

a liquid delivery conduit having a liquid receiving inlet and a liquid dispensing outlet interconnected one with the other in fluid communication by a liquid delivery throughpassage;

a liquid recovery conduit having a liquid receiving inlet and a liquid conveying outlet interconnected one with the other in fluid communication by a liquid recovery throughpassage, and having a sensor retaining portion;

a valve having a first movable valve portion disposed in said liquid delivery conduit and movable between a valve closed position whereat liquid is precluded from being dispensed from said liquid dispensing outlet of said liquid delivery conduit and a valve open position whereat liquid is permitted to be dispensed from said liquid dispensing outlet of said liquid delivery conduit;

a manually operable valve control mechanism reconfigurable between an operating configuration whereat force can be transmitted by said valve control mechanism to said valve to thereby move said first movable valve portion to said valve open position, and a non operating configuration whereat force cannot be transmitted by said valve control mechanism to said valve; and, a liquid sensor disposed within said sensor retaining portion of said liquid recovery conduit, and having a rest state and an actuated state whereat said liquid sensor reconfigures said valve control mechanism from said operating configuration to said non operating configuration, wherein said liquid sensor is responsive to a threshold condition of liquid in said sensor retaining portion of said liquid recovery conduit, to thereby cause said liquid sensor to be in said actuated state.

2. The automatic shut off nozzle of claim 1, wherein said manually operable valve control mechanism comprises a manually operable trigger for moving said first movable valve portion of said valve to said valve open position.

3. The automatic shut off nozzle of claim 2, wherein said manually operable valve control mechanism comprises a linkage mechanism operatively connecting said manually operable trigger and said valve.

4. The automatic shut off nozzle of claim 3, wherein said linkage mechanism comprises a first link arm and a second link arm connected one to the other in angularly variable relation at a linkage elbow.

5. The automatic shut off nozzle of claim 4, wherein said first link arm and said second link arm are connected one to the other in pivotal relation at said linkage elbow.

6. The automatic shut off nozzle of claim 4, wherein said first link arm is connected to said manually operable trigger in pivotal relation.

7. The automatic shut off nozzle of claim 4, wherein said linkage mechanism further comprises a pusher link arm interconnected between said trigger and said valve, for transmitting force from said second link arm to said valve, to thereby permit said valve to be moved to said valve open position.

8. The automatic shut off nozzle of claim 7, wherein said pusher link arm and said second link arm are connected one to the other in angularly variable relation.

9. The automatic shut off nozzle of claim 1, wherein said liquid recovery conduit further comprises a spout portion, and wherein said sensor retaining portion is disposed between said spout portion and said liquid conveying outlet.

10. The automatic shut off nozzle of claim 9, wherein said sensor retaining portion of said liquid recovery conduit is oriented generally transversely to said spout portion of said liquid recovery conduit.

11. The automatic shut off nozzle of claim 3, wherein said liquid sensor comprises a piston slidably mounted in said sensor retaining portion of said liquid recovery conduit for movement between a rest position corresponding to said rest state of said liquid sensor and an actuated position corresponding to said actuated state of said liquid sensor.

12. The automatic shut off nozzle of claim 11, wherein said piston is responsive to a threshold condition of liquid in said liquid recovery conduit to thereby cause movement of said first movable valve portion to said valve closed position.

13. The automatic shut off nozzle of claim 11, wherein said linkage mechanism comprises a ferrous portion, and wherein said liquid sensor further comprises a sensor magnet operatively connected to said sensor for movement between a rest position corresponding to the rest position of said piston and a link disabling position corresponding to the actuated position of said piston and whereat the magnetic force from said sensor magnet acts on said ferrous portion of said linkage mechanism to move said linkage mechanism to said non operating configuration.

14. The automatic shut off nozzle of claim 13, wherein said ferrous portion comprises a linkage magnet.

15. The automatic shut off nozzle of claim 14, wherein said sensor magnet is operatively connected to said piston for movement therewith.

16. The automatic shut off nozzle of claim 15, wherein said sensor magnet is mounted on said piston for movement therewith.

17. The automatic shut off nozzle of claim 16, wherein said linkage mechanism comprises a first link arm and a second link arm connected one to the other in angularly variable relation at a linkage elbow and said linkage magnet is mounted on one of said first link arm and said second link arm for movement therewith.

18. The automatic shut off nozzle of claim 14, wherein said sensor magnet and said linkage magnet are oriented such that said linkage magnet is repelled by said sensor magnet when said piston is in said actuated position.

19. The automatic shut off nozzle of claim 11, wherein the cross sectional area separating said piston of said liquid sensor and said liquid recovery conduit is between the minimum cross sectional area of said liquid recovery conduit and the predominant cross sectional area of said liquid delivery throughpassage of said liquid recovery conduit.

* * * * *